US011814817B2

(12) United States Patent
Yamanaka et al.

(10) Patent No.: US 11,814,817 B2
(45) Date of Patent: Nov. 14, 2023

(54) SYSTEM INCLUDING WORK MACHINE, COMPUTER IMPLEMENTED METHOD, METHOD FOR PRODUCING TRAINED POSITION ESTIMATION MODEL, AND TRAINING DATA

(71) Applicant: KOMATSU LTD., Tokyo (JP)

(72) Inventors: Nobuyoshi Yamanaka, Tokyo (JP); Toshiaki Kumagai, Tokyo (JP); Kensuke Fujii, Tokyo (JP)

(73) Assignee: KOMATSU LTD., Tokyo (JP)

( * ) Notice: Subject to any disclaimer, the term of this patent is extended or adjusted under 35 U.S.C. 154(b) by 543 days.

(21) Appl. No.: 16/978,839

(22) PCT Filed: Mar. 19, 2019

(86) PCT No.: PCT/JP2019/011560
§ 371 (c)(1),
(2) Date: Sep. 8, 2020

(87) PCT Pub. No.: WO2019/239668
PCT Pub. Date: Dec. 19, 2019

(65) Prior Publication Data

US 2021/0002871 A1 Jan. 7, 2021

(30) Foreign Application Priority Data

Jun. 11, 2018 (JP) ..... 2018-111231

(51) Int. Cl.
*E02F 9/26* (2006.01)
*E02F 3/32* (2006.01)
*E02F 9/20* (2006.01)

(52) U.S. Cl.
CPC ..... *E02F 9/265* (2013.01); *E02F 3/32* (2013.01); *E02F 9/2041* (2013.01); *E02F 9/262* (2013.01)

(58) Field of Classification Search
CPC ..... E02F 9/265; E02F 9/2041; E02F 9/262; E02F 9/264; E02F 3/32; E02F 3/435
See application file for complete search history.

(56) References Cited

U.S. PATENT DOCUMENTS 5,974,352 A * 10/1999 Shull ..... E02F 3/432 701/50
2004/0158355 A1* 8/2004 Holmqvist ..... G05D 1/0236 701/23

(Continued)

FOREIGN PATENT DOCUMENTS

JP 2005-194825 A 7/2005
JP 2008-063775 A 3/2008

(Continued)

OTHER PUBLICATIONS

Mulligan et al., A Model-based Vision System for Manipulator Position Sensing, Google Scholar, University of British Columbia, Department of Computer Science, pp. 1-25. (Year: 1989).*

(Continued)

*Primary Examiner* — Russell Frejd
(74) *Attorney, Agent, or Firm* — Faegre Drinker Biddle & Reath LLP

(57) ABSTRACT

A work implement's position is determined. Provided is a system including a work machine, the system comprising: a work machine body; a work implement attached to the work machine body; an imaging device that captures an image of the work implement; and a computer. The computer includes a trained position estimation model. The computer is programmed to obtain the image of the work implement captured by the imaging device and use the trained position estimation model to obtain a position of the work implement estimated from the captured image.

14 Claims, 10 Drawing Sheets

(56) References Cited

U.S. PATENT DOCUMENTS

| | | | | |
|---|---|---|---|---|
| 2010/0121540 | A1 | 5/2010 | Kumagai et al. | |
| 2010/0249957 | A1* | 9/2010 | Price | G08C 17/02 700/83 |
| 2016/0170089 | A1* | 6/2016 | Collins | G01S 7/003 702/5 |
| 2016/0170090 | A1* | 6/2016 | Collins | G01S 7/003 702/5 |
| 2017/0284071 | A1 | 10/2017 | Yamaguchi et al. | |
| 2018/0171582 | A1 | 6/2018 | Yamada et al. | |
| 2018/0266083 | A1 | 9/2018 | Narikawa et al. | |

FOREIGN PATENT DOCUMENTS

| | | | |
|---|---|---|---|
| JP | 2010-117230 | A | 5/2010 |
| JP | 2015-063864 | A | 4/2015 |
| JP | 2017-071982 | A | 4/2017 |
| WO | WO-2016/148309 | A1 | 9/2016 |
| WO | WO 2017/010212 | A1 | 1/2017 |

OTHER PUBLICATIONS

Soltani et al., Skeleton Estimation of Excavator by Detecting Its Parts, Google Scholar, Automation in Progress, pp. 1-15. (Year: 2017).*

* cited by examiner

SYSTEM INCLUDING WORK MACHINE, COMPUTER IMPLEMENTED METHOD, METHOD FOR PRODUCING TRAINED POSITION ESTIMATION MODEL, AND TRAINING DATA

TECHNICAL FIELD

The present disclosure relates to a system including a work machine, a computer implemented method, a method for producing a trained position estimation model, and training data.

BACKGROUND ART

For a hydraulic excavator, Japanese Patent Laying-Open No. 2017-71982 (PTL 1) discloses attaching a boom angle sensor to a boom pin, a dipper stick angle sensor to a dipper stick pin, and a bucket angle sensor to a bucket link to sense values which are in turn used to calculate the position of the tip of a tooth of the bucket.

CITATION LIST

Patent Literature

PTL 1: Japanese Patent Laying-Open No. 2017-71982

SUMMARY OF INVENTION

Technical Problem

The configuration described in the above document necessitates attaching an angle sensor to an axis of each of the boom, the dipper stick and the bucket in order to determine the posture of a work implement, which invites an increased number of components.

Herein is disclosed a system including a work machine, a computer implemented method, a method for producing a trained position estimation model, and training data to determine the position of a work implement.

Solution to Problem

In one aspect of the present disclosure, there is provided a system comprising: a work machine body; a work implement attached to the work machine body; an imaging device that captures an image of the work implement; and a computer. The computer has a trained position estimation model to determine a position of the work implement. The computer is programmed to obtain the image of the work implement captured by the imaging device and use the trained position estimation model to obtain a position of the work implement estimated from the captured image.

In one aspect of the present disclosure, there is provided a method implemented by a computer. The method comprises the following steps: A first step is to obtain an image including a work implement provided to a work machine body. A second step is to use a trained position estimation model for determining a position of the work implement to obtain a position of the work implement estimated from the obtained image.

In one aspect of the present disclosure, there is provided a method for producing a trained position estimation model. The method comprises the following steps: A first step is to obtain training data. The training data includes a captured image of a work implement attached to a work machine body, and a position of the work implement measured when the image is captured. A second step is to train the position estimation model by using the training data.

In one aspect of the present disclosure, there is provided training data for training a position estimation model used to determine a position of a work implement. The training data comprises: an image of the work implement captured by an imaging device; and a position of the work implement measured when the image is captured.

In one aspect of the present disclosure, there is provided a method for producing a trained position estimation model. The method comprises the following steps: A first step is to obtain a captured image of a work implement attached to a work machine body. A second step is to use a trained first position estimation model to obtain a position of the work implement estimated from the captured image. A third step is to train a second position estimation model by using training data including the captured image and the estimated position.

Advantageous Effects of Invention

The present disclosure thus allows the position of a work implement to be determined accurately.

DESCRIPTION OF EMBODIMENTS

Hereinafter, an embodiment will be described with reference to the drawings. In the following description, identical components are identically denoted. Their names and functions are also identical. Accordingly, they will not be described repeatedly.

Figure 1:
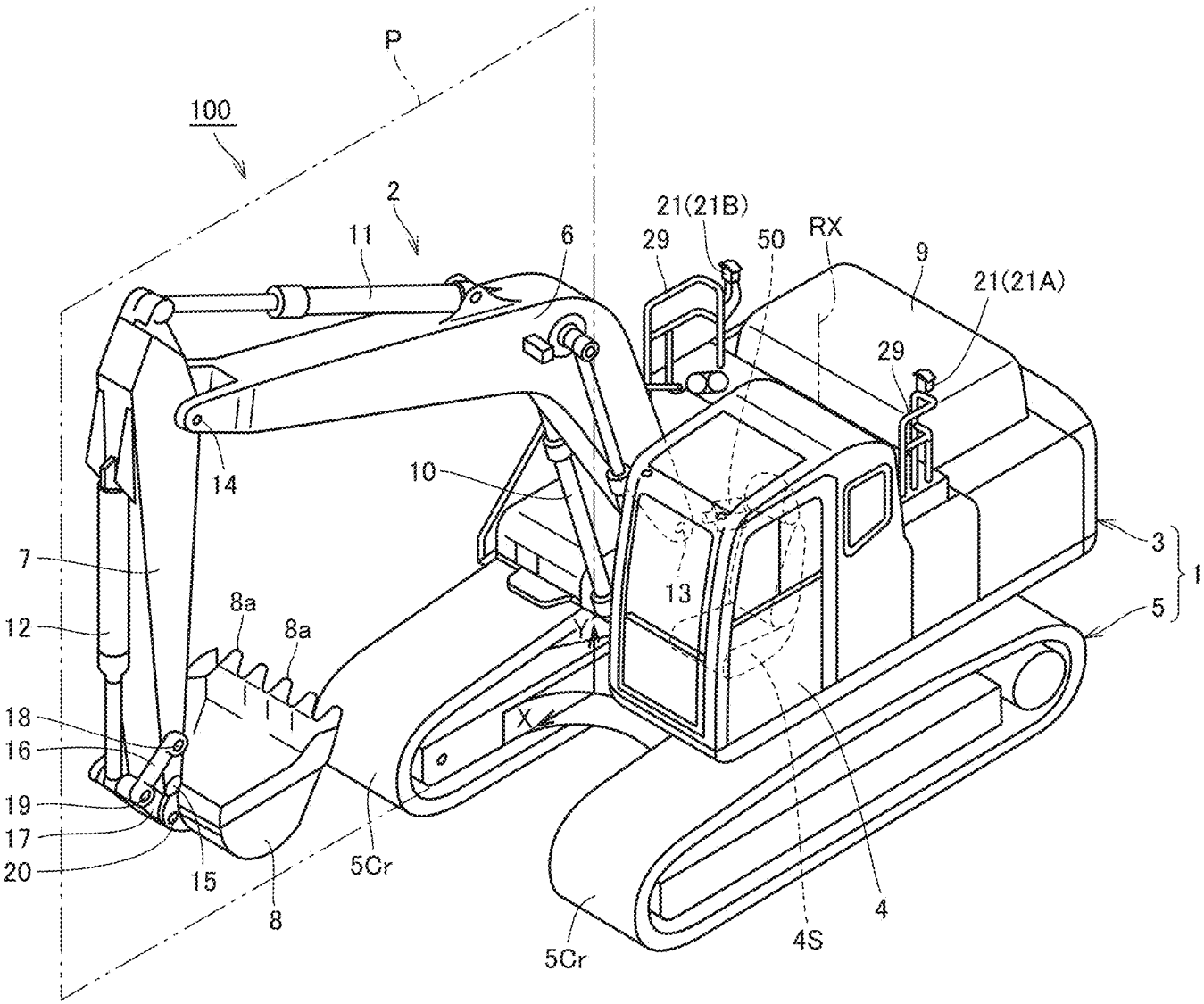
FIG. 1 is an appearance of a hydraulic excavator based on an embodiment.

In the embodiment, initially will be described a configuration of a hydraulic excavator which is an example of a work machine to which the idea of the present disclosure is applicable. FIG. 1 shows an appearance of a hydraulic excavator 100 based on an embodiment.

As shown in FIG. 1, hydraulic excavator 100 has a main body 1 and a hydraulically operated work implement 2. Main body 1 has a revolving unit 3 and a traveling apparatus 5. Traveling apparatus 5 has a pair of crawler belts 5Cr. Hydraulic excavator 100 can travel as crawler belts 5Cr rotate. Traveling apparatus 5 may have wheels (tires).

Revolving unit 3 is disposed on traveling apparatus 5 and supported by traveling apparatus 5. Revolving unit 3 can revolve about an axis of revolution RX with respect to traveling apparatus 5. Revolving unit 3 has a cab 4. An occupant (or operator) of hydraulic excavator 100 gets in cab 4 and operates hydraulic excavator 100. Cab 4 is provided with an operator's seat 4S where the operator sits. The operator can operate hydraulic excavator 100 in cab 4. The operator in cab 4 can operate work implement 2, operate revolving unit 3 to revolve it with respect to traveling apparatus 5, and operate traveling apparatus 5 to cause hydraulic excavator 100 to travel.

Revolving unit 3 has an engine compartment 9 accommodating an engine and a counterweight provided in a rear portion of revolving unit 3. In engine compartment 9 are disposed an engine, a hydraulic pump and so forth (not shown).

Revolving unit 3 is provided with a handrail 29 frontwardly of engine compartment 9. Handrail 29 is provided with an antenna 21. Antenna 21 is for example an antenna for GNSS (Global Navigation Satellite Systems). Antenna 21 has a first antenna 21A and a second antenna 21B provided on revolving unit 3 and spaced from each other in a vehicular widthwise direction.

Work implement 2 is supported by revolving unit 3. Work implement 2 has a boom 6, a dipper stick 7, and a bucket 8. Boom 6 is pivotably coupled to revolving unit 3. Dipper stick 7 is pivotably coupled to boom 6. Bucket 8 is pivotably coupled to dipper stick 7. Bucket 8 has a plurality of teeth. Bucket 8 has a distal end portion, which will be referred to as a tooth tip 8*a*.

Boom 6 has a proximal end portion coupled to revolving unit 3 via a boom pin 13. Dipper stick 7 has a proximal end portion coupled to a distal end portion of boom 6 via a dipper stick pin 14. Bucket 8 is coupled to a distal end portion of dipper stick 7 via a bucket pin 15. Bucket 8 is an example of an attachment detachably attached to a tip of work implement 2. Depending on the type of work, the attachment is replaced with a breaker, grapple, a lifting magnet, or the like.

Hydraulic excavator 100 has a variety of components, and in the present embodiment, their positional relationship will be described with work implement 2 serving as a reference.

Boom 6 of work implement 2 pivots with respect to revolving unit 3 about boom pin 13 provided at the proximal end portion of boom 6. When a specific portion of boom 6 which pivots with respect to revolving unit 3, for example, a distal end portion of boom 6 moves, it provides a locus in an arc. A plane including the arc is specified as an operating plane P. When hydraulic excavator 100 is seen in a plan view, operating plane P is represented as a straight line. The straight line extends in a direction, which is a fore/aft direction of main body 1 of hydraulic excavator 100 or revolving unit 3, and it is hereinafter also simply referred to as the fore/aft direction. A lateral direction (or vehicular widthwise direction) of main body 1 of hydraulic excavator 100 or a lateral direction of revolving unit 3 is orthogonal to the fore/aft direction in a plan view, and it is hereinafter also simply referred to as the lateral direction.

A side where work implement 2 protrudes from main body 1 of hydraulic excavator 100 in the fore/aft direction is the fore direction and a direction opposite to the fore direction is the aft direction. A right side and a left side of the lateral direction when one faces front are the right direction and the left direction, respectively.

The fore/aft direction refers to a fore/aft direction of an operator who sits at the operator's seat in cab 4. A direction in which the operator sitting at the operator's seat faces is defined as the fore direction and a direction behind the operator who sits at the operator's seat is defined as the aft direction. The lateral direction refers to a lateral direction of the operator who sits at the operator's seat. A right side and a left side when the operator sitting at the operator's seat faces front are defined as the right direction and the left direction, respectively.

Boom 6 is pivotable about boom pin 13. Dipper stick 7 is pivotable about dipper stick pin 14. Bucket 8 is pivotable about bucket pin 15. Dipper stick 7 and bucket 8 are each a movable member movable on the side of the distal end of boom 6. Boom pin 13, dipper stick pin 14, and bucket pin 15 extend in a direction orthogonal to operating plane P, i.e., in the lateral direction. Operating plane P is orthogonal to at least one (in the embodiment, all three) of axes that serve as centers about which boom 6, dipper stick 7, and bucket 8 pivot.

As has been set forth above, boom 6 pivots on operating plane P with respect to revolving unit 3. Similarly, dipper stick 7 pivots on operating plane P with respect to boom 6, and bucket 8 pivots on operating plane P with respect to dipper stick 7. Work implement 2 of the embodiment has its entirety operated on operating plane P. Tooth tip 8*a* of bucket 8 moves on operating plane P. Operating plane P is a vertical plane including a range in which work implement 2 is movable. Operating plane P intersects each of boom 6, dipper stick 7, and bucket 8. Operating plane P can be set at a center of boom 6, dipper stick 7, and bucket 8 in the lateral direction.

As shown in FIG. 1, in the present specification, an X axis is set in a horizontal direction on operating plane P and a Y axis is set in a vertically upward direction on operating plane P. The X axis and the Y axis are orthogonal to each other.

Work implement 2 has a boom cylinder 10, a dipper stick cylinder 11, and a bucket cylinder 12. Boom cylinder 10 drives boom 6. Dipper stick cylinder 11 drives dipper stick 7. Bucket cylinder 12 drives bucket 8. Boom cylinder 10, dipper stick cylinder 11, and bucket cylinder 12 are each a hydraulic cylinder driven with hydraulic oil.

Work implement 2 has a bucket link. The bucket link has a first link member 16 and a second link member 17. First link member 16 and second link member 17 have their respective tips relatively rotatably coupled together via a bucket cylinder top pin 19. Bucket cylinder top pin 19 is coupled to a tip of bucket cylinder 12. Therefore, first link member 16 and second link member 17 are pinned to bucket cylinder 12.

First link member 16 has a proximal end rotatably coupled to dipper stick 7 via a first link pin 18 in a vicinity of bucket pin 15 located at the distal end portion of dipper stick 7. First link member 16 is pinned to dipper stick 7. Second link member 17 has a proximal end rotatably coupled via a second link pin 20 to a bracket located at a foot of bucket 8. Second link member 17 is pinned to bucket 8.

Hydraulic excavator 100 has an imaging device 50. Imaging device 50 in the embodiment is a monocular camera.

Imaging device 50 is attached to revolving unit 3. Imaging device 50 is attached to cab 4. Imaging device 50 is attached inside cab 4. Imaging device 50 is attached in a vicinity of an upper end of a left front pillar of cab 4. Imaging device 50 is disposed in an internal space of cab 4 in a vicinity of the left front pillar at a position away from work implement 2 in the lateral direction. Imaging device 50 is disposed apart from operating plane P of work implement 2 in the lateral direction. Imaging device 50 is disposed leftwardly of operating plane P.

Figure 2:
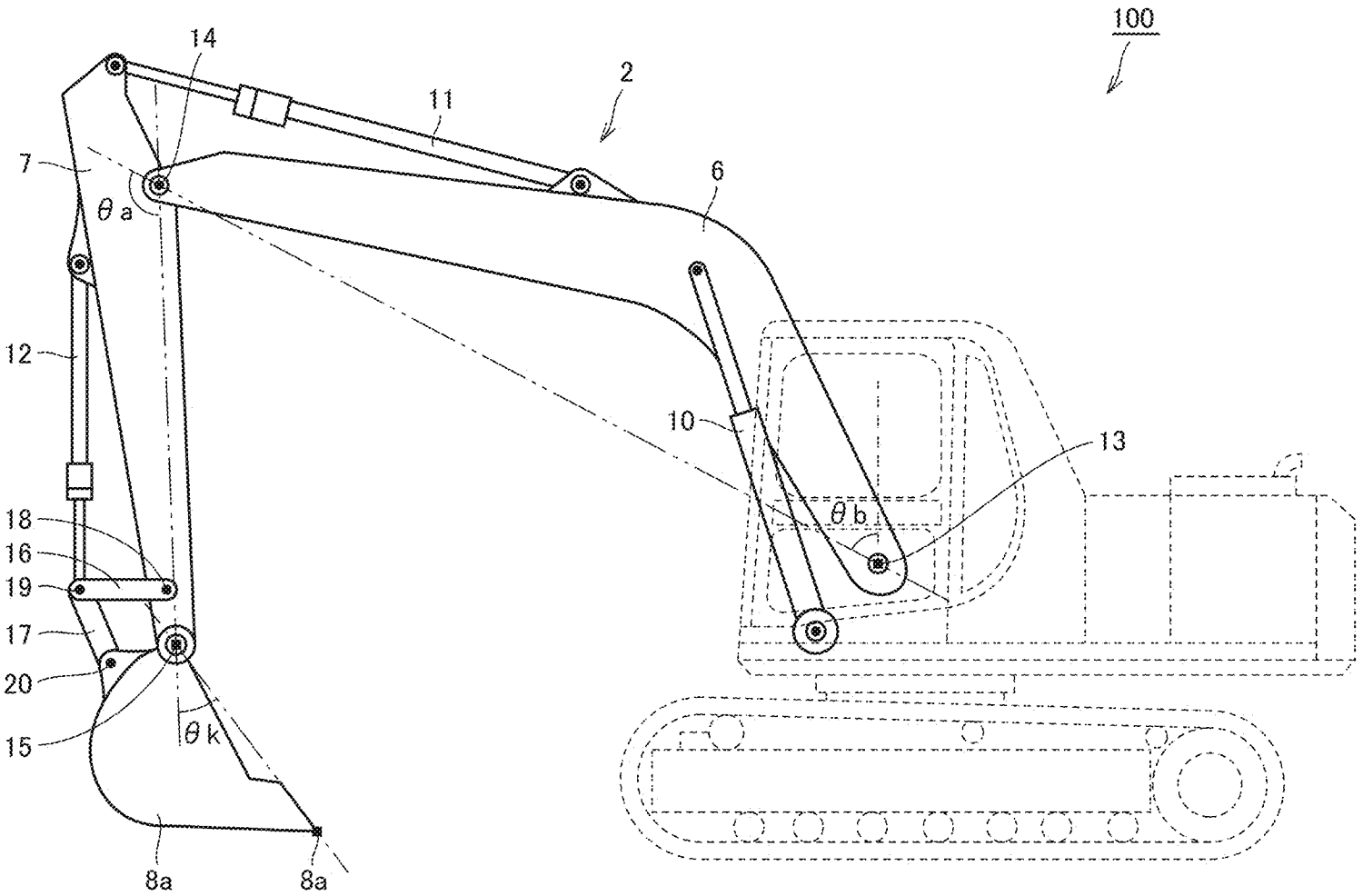
FIG. 2 is a side view of a work implement for illustrating a boom angle, a dipper stick angle, and a bucket angle.

FIG. 2 is a side view of work implement 2 for illustrating a boom angle θb, a dipper stick angle θa, and a bucket angle θk.

As shown in FIG. 2, an angle formed in a side view by a straight line passing through boom pin 13 and dipper stick pin 14 and a straight line extending in the vertical direction is defined as boom angle θb. Boom angle θb is an angle of boom 6 with respect to revolving unit 3.

An angle formed in a side view by a straight line passing through boom pin 13 and dipper stick pin 14 and a straight line passing through dipper stick pin 14 and bucket pin 15 is defined as dipper stick angle θa. Dipper stick angle θa is an angle of dipper stick 7 with respect to boom 6.

An angle formed in a side view by a straight line passing through dipper stick pin 14 and bucket pin 15 and a straight line passing through bucket pin 15 and tooth tip 8*a* is defined as bucket angle θk. Bucket angle θk is an angle of bucket 8 with respect to dipper stick 7.

A posture of work implement 2 on operating plane P is determined by a combination of boom angle θb, dipper stick angle θa, and bucket angle θk. For example, a position, or XY coordinates, on operating plane P of first link pin 18 located at the distal end portion of dipper stick 7 is determined by a combination of boom angle θb and dipper stick angle θa. A position, or XY coordinates, on operating plane P of bucket cylinder top pin 19 displacing as bucket 8 operates is determined by a combination of boom angle θb, dipper stick angle θa, and bucket angle θk.

Figure 3:
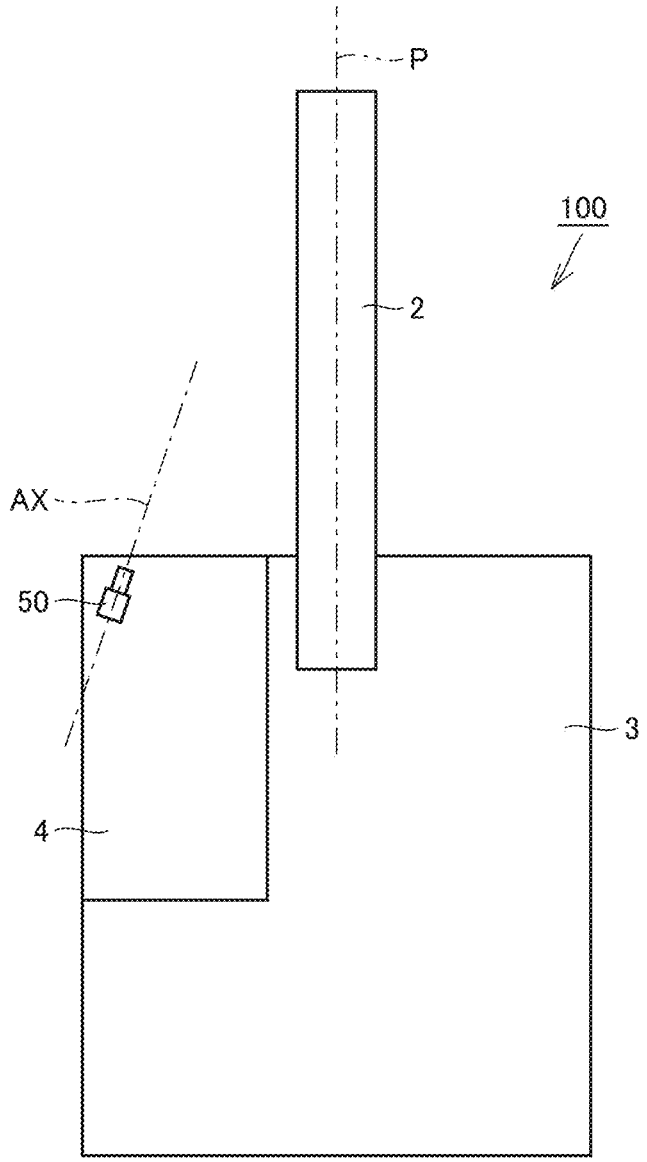
FIG. 3 is a schematic plan view of the hydraulic excavator shown in FIG. 1.

FIG. 3 is a schematic plan view of hydraulic excavator 100 shown in FIG. 1. FIG. 3 schematically illustrates work implement 2, revolving unit 3, cab 4, and imaging device 50 described with reference to FIG. 1. Operating plane P in FIG. 3 is represented as a straight line extending in the vertical direction in the figure, and is indicated by a chain double-dashed line. An optical axis AX indicated by a dot-dashed line in FIG. 3 is an optical axis of imaging device 50. Optical axis AX and operating plane P do not extend in parallel. Optical axis AX extends in a direction inclined with respect to that in which operating plane P extends. Optical axis AX intersects operating plane P.

Imaging device 50 is attached at a position at which the operating plane of work implement 2 is viewed in an oblique direction. Imaging device 50 captures an image of work implement 2 at an angle larger than 0° with respect to operating plane P. Work implement 2 and imaging device 50 are both attached to revolving unit 3, and even when hydraulic excavator 100 travels or revolves, imaging device 50 has a positional relationship unchanged with respect to operating plane P. A position at which imaging device 50 is attached with respect to operating plane P is predetermined for each type of hydraulic excavator 100.

Imaging device 50 captures an image of work implement 2. Imaging device 50 images operating plane P of work implement 2. Imaging device 50 captures an image of work implement 2 moving on operating plane P. The image captured by imaging device 50 includes at least a portion of work implement 2.

Figure 4:
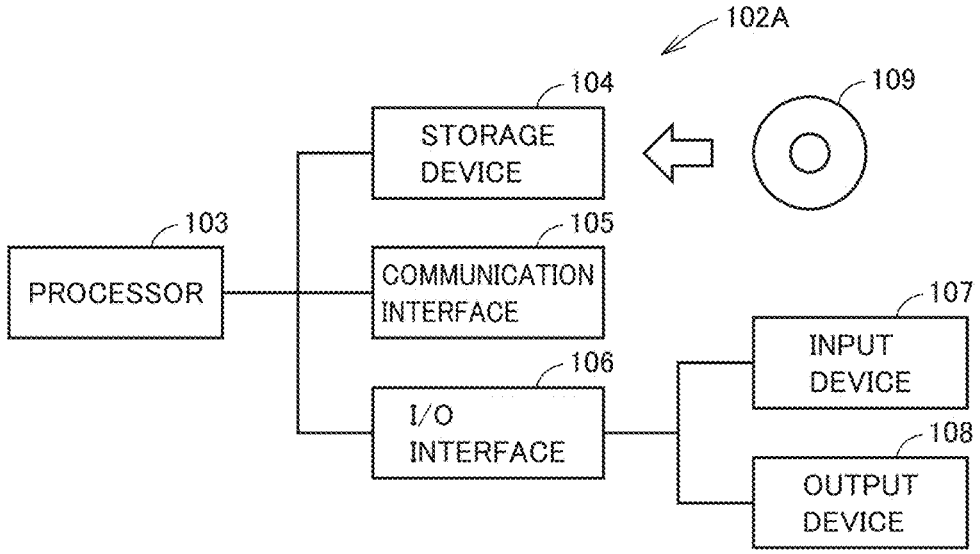
FIG. 4 schematically shows a configuration of a computer included in a system including a work machine.

FIG. 4 is a schematic diagram showing a configuration of a computer 102A included in a system including the work machine. The system according to the embodiment is a system for determining a position of work implement 2 relative to the main body of the work machine (main body 1). The system according to the embodiment includes hydraulic excavator 100 as an example of the work machine described with reference to FIGS. 1 to 3 and computer 102A shown in FIG. 4.

Computer 102A may be designed exclusively for the system according to the embodiment, or may be a general-purpose PC (Personal Computer). Computer 102A has a processor 103, a storage device 104, a communication interface 105, and an I/O interface 106. Processor 103 is, for example, a CPU (Central Processing Unit).

Storage device 104 includes a medium that stores information such as stored programs and data readably by processor 103. Storage device 104 includes a system memory such as a RAM (Random Access Memory) or a ROM (Read Only Memory), and an auxiliary storage device. The auxiliary storage device may be a magnetic recording medium such as a hard disk, an optical recording medium such as a CD (Compact Disc) and a DVD (Digital Versatile Disc), or a semiconductor memory such as a flash memory. Storage device 104 may be incorporated in computer 102A. Storage device 104 may include an external recording medium 109 that is detachably connected to computer 102A. External recording medium 109 may be a CD-ROM.

Communication interface 105 is, for example, a wired LAN (Local Area Network) module or a wireless LAN module, and is an interface for performing communications via a communication network. I/O interface 106 is, for example, a USB (Universal Serial Bus) port, and is an interface for connecting to an external device.

Computer 102A is connected to input device 107 and output device 108 via I/O interface 106. Input device 107 is a device for a user to input to computer 102A. Input device 107 includes a pointing device such as a mouse or a trackball, for example. Input device 107 may include a device such as a keyboard used to input text. Output device 108 includes, for example, a display.

Figure 5:
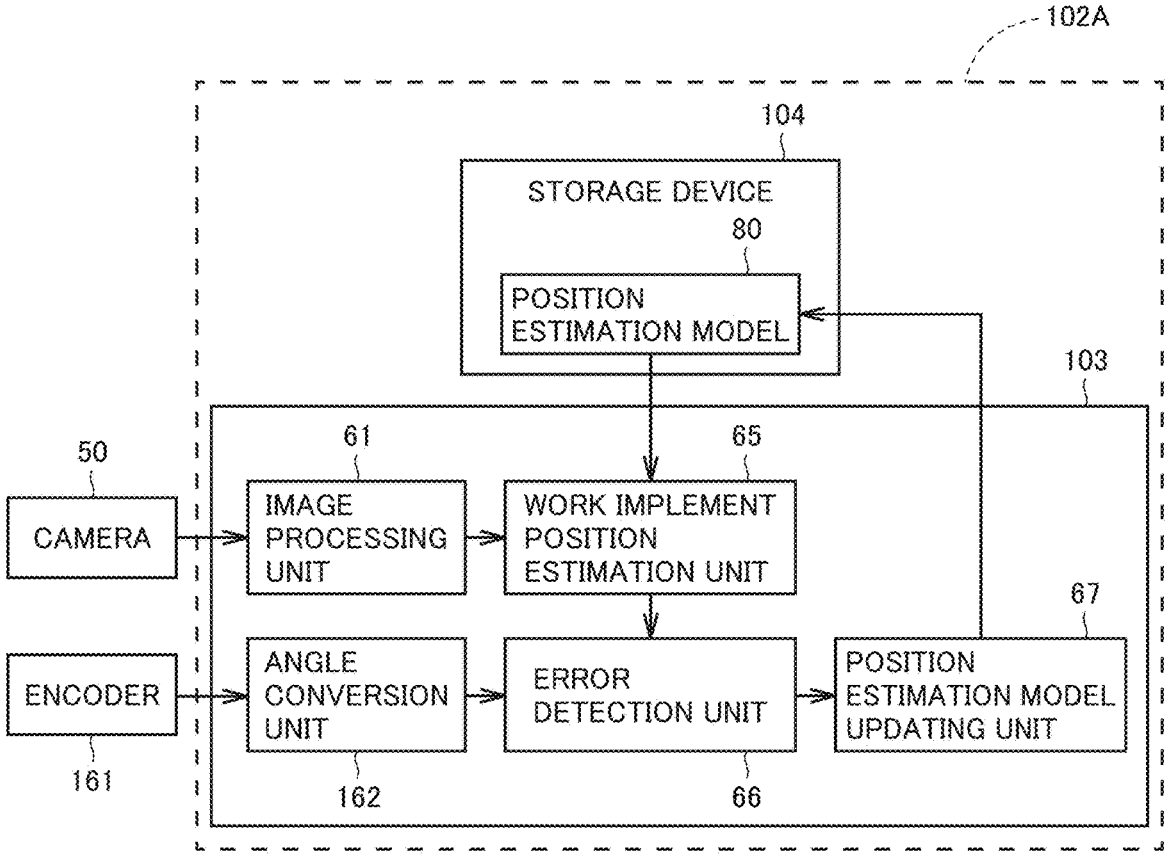
FIG. 5 is a block diagram showing a system configuration of the hydraulic excavator before shipment.

FIG. 5 is a block diagram showing a system configuration of hydraulic excavator 100 before shipment. Processor 103 and storage device 104 shown in FIG. 5 configure a part of computer 102A shown in FIG. 4. Processor 103 has an image processing unit 61 and a work implement position estimation unit 65. Storage device 104 has a trained position estimation model 80 stored therein.

Image processing unit 61 receives from imaging device (a camera) 50 an image captured thereby. Image processing unit 61 subjects the received captured image to image processing.

Position estimation model 80 is an artificial intelligence model for determining a position of work implement 2 relative to main body 1. Position estimation model 80 is configured to determine a relative position of work implement 2 from a captured image. Computer 102A estimates the relative position of work implement 2 by using the position estimation model of artificial intelligence. Work implement position estimation unit 65 uses position estimation model 80 to obtain a relative position of work implement 2 estimated from a captured image. More specifically, work implement position estimation unit 65 reads position estimation model 80 from storage device 104 and inputs a captured image to position estimation model 80 to obtain an output of a result of an estimation of boom angle θb, dipper stick angle θa, and bucket angle θk.

Position estimation model 80 includes a neural network. Position estimation model 80 includes, for example, a deep neural network such as a convolutional neural network (CNN).

The model in the embodiment may be implemented in hardware, software executable on hardware, firmware, or a combination thereof. The model may include programs, algorithms, and data executed by processor 103. The model may have its functionalities implemented by a single module or distributed among multiple modules and implemented thereby. The model may be distributed among a plurality of computers.

Hydraulic excavator 100 before shipment further includes an encoder 161. Encoder 161 is a general term for a boom angle sensor attached to boom pin 13, a dipper stick angle sensor attached to the dipper stick pin, and a bucket angle sensor attached to the bucket link. Instead of encoder 161, a potentiometer may be attached to work implement 2 to measure an angle. A stroke sensor that senses the stroke of the hydraulic cylinder may be attached to convert an amount of movement of the hydraulic cylinder into an angle.

Processor 103 has an angle conversion unit 162, an error detection unit 66, and a position estimation model updating unit 67. Angle conversion unit 162 receives an electrical signal from encoder 161 and converts the electrical signal into boom angle θb, dipper stick angle θa, and bucket angle θk. Encoder 161 obtains an electrical signal at a time when imaging device 50 captures an image, and outputs the electrical signal to angle conversion unit 162. Angle conversion unit 162 associates boom angle θb, dipper stick angle θa and bucket angle θk that are measured when the image is captured with the captured image, and thus obtains the angles.

Error detection unit 66 compares a result of an estimation of boom angle θb, dipper stick angle θa and bucket angle θk by work implement position estimation unit 65 with a result of a measurement of boom angle θb, dipper stick angle θa and bucket angle θk based on a result of detection by encoder 161 converted in angle conversion unit 162. Error detection unit 66 calculates an error of the result of the estimation with respect to the true values of boom angle θb, dipper stick angle θa and bucket angle θk.

Position estimation model updating unit 67 updates position estimation model 80 based on the error of boom angle θb, dipper stick angle θa and bucket angle θk as calculated by error detection unit 66. In this way, position estimation model 80 is trained. An image of work implement 2 captured by imaging device 50, and boom angle θb, dipper stick angle θa and bucket angle θk obtained when the image is captured that are calculated in angle conversion unit 162 configure data for training position estimation model 80. Position estimation model 80 is trained in a factory before hydraulic excavator 100 is shipped.

Figure 6:
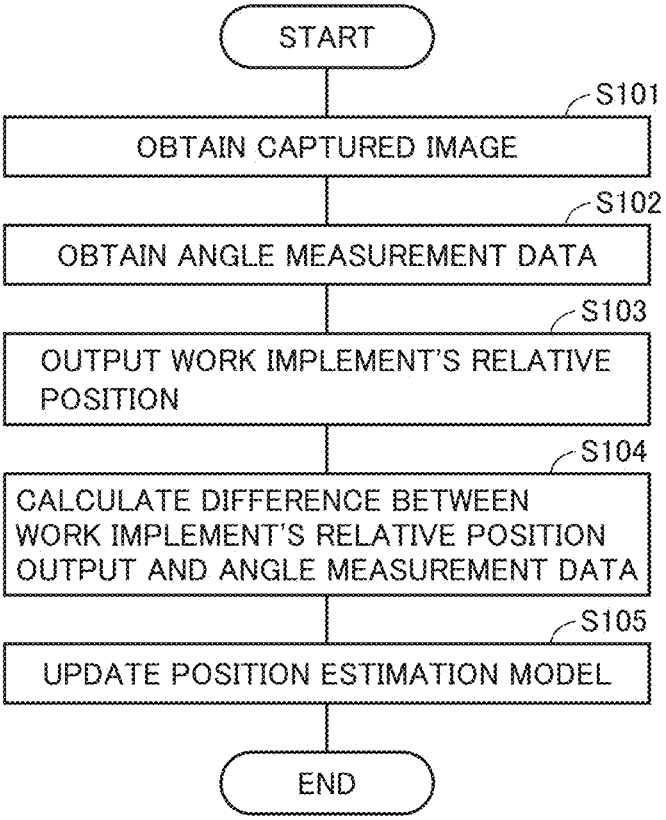
FIG. 6 is a flowchart of a method for producing a position estimation model trained.
Figure 7:
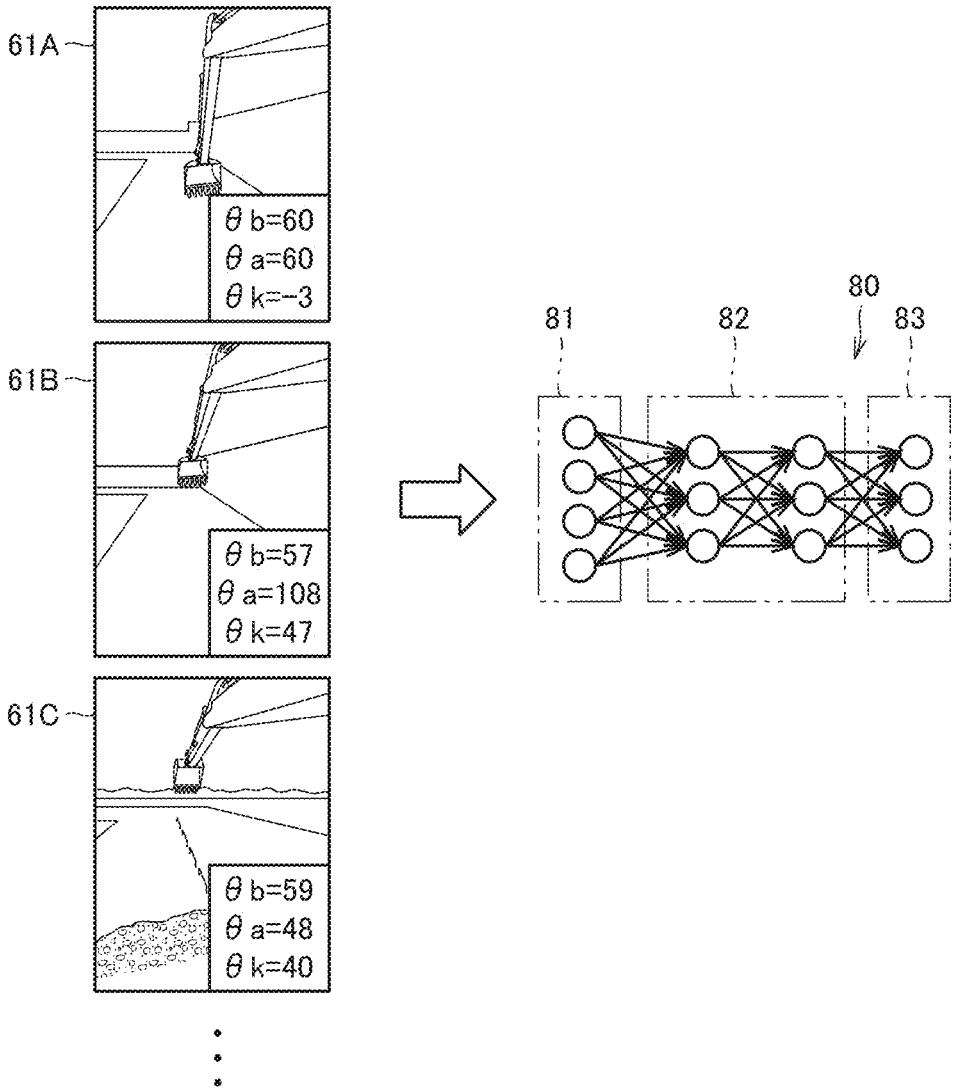
FIG. 7 is a schematic diagram for illustrating a process for training a position estimation model.

FIG. 6 is a flowchart of a method for producing position estimation model 80 trained. FIG. 7 is a schematic diagram for illustrating a process for training position estimation model 80. Although there is some overlapping with the contents described with reference to FIG. 5, a process for training position estimation model 80 for estimating a position of work implement 2 relative to main body 1 will now be described below with reference to FIGS. 6 and 7.

As shown in FIG. 6, initially, in step S101, a captured image is obtained. Computer 102A, more specifically, image processing unit 61, obtains from imaging device (or a camera) 50 an image captured by imaging device 50. The captured image is timestamped so that when the image is captured can be determined. Image processing unit 61 may obtain in real time an image captured by imaging device 50. Image processing unit 61 may obtain a captured image from imaging device 50 at a prescribed time or whenever a prescribed period of time elapses. Image processing unit 61 subjects the captured image to image processing and stores the thus processed image in storage device 104.

Subsequently, in step S102, angle measurement data is obtained. Computer 102A, more specifically, angle conversion unit 162, obtains from encoder 161 measurement data of boom angle θb, dipper stick angle θa and bucket angle θk detected by encoder 161. The measurement data is assumed to be assigned to the captured image. An image captured at a specific time is associated with measurement data detected at that specific time. As shown in FIG. 7, training data 61A, 61B, 61C, . . . , including a captured image and a measured position which is an angle of work implement 2 measured when the image is captured is created.

The training data includes a plurality of captured images of work implement 2 in different postures, as shown in FIG. 7. The training data may include a plurality of images of work implement 2 captured in the same posture in different environments such as daytime, backlight, and nighttime.

Subsequently, in step S103, a relative position of work implement 2 is output. Computer 102A, more specifically, work implement position estimation unit 65, reads position estimation model 80 from storage device 104. Position estimation model 80 includes a neural network shown in FIG. 7. The neural network includes an input layer 81, an intermediate layer (or a hidden layer) 82, and an output layer 83. Each layer 81, 82, 83 has one or more neurons. The number of neurons in each layer 81, 82, 83 can be set as appropriate.

Immediately adjacent layers have their neurons connected together, and for each connection a weight (a connection weight) is set. The number of connections of neurons may be set as appropriate. A threshold value is set for each neuron, and an output value of each neuron is determined by whether a sum of products of a value input to each neuron and a weight exceeds the threshold value.

Position estimation model 80 is trained to determine a relative position of work implement 2 from a captured image. Through training, a parameter is obtained for position estimation model 80, and the parameter is stored in storage device 104. The parameter includes, for example, the number of layers of the neural network, the number of neurons in each layer, a relation in which neurons are connected together, a weight applied to a connection between each neuron and another neuron, and a threshold value for each neuron.

Work implement position estimation unit 65 inputs an image captured by imaging device 50 to input layer 81. Output layer 83 outputs a position of work implement 2 relative to main body 1, more specifically, a value indicating boom angle θb, dipper stick angle θa and bucket angle θk. For example, computer 102A uses the captured image as an input to input layer 81 to perform a computation process for a forward propagation through the neural network of position estimation model 80. As a result, computer 102A obtains an estimated relative position of work implement 2 as a value output from output layer 83 of the neural network.

Step S102 may not be followed by step S103. Step S102 and Step S103 may be performed at the same time, or step S103 may precede step S102.

Subsequently, in step S104, a difference is calculated between the estimated position of work implement 2 output in step S103 and the measurement data of the angles of work implement 2 obtained in step S102. Computer 102A, more specifically, error detection unit 66, compares the relative position of work implement 2 estimated from the captured image and output from output layer 83 of position estimation model 80 with the measured relative position of work implement 2 as obtained in angle conversion unit 162 to calculate an error of the estimated value with respect to the true value of the relative position of work implement 2.

Computer 102A trains position estimation model 80 using a captured image as input data and a relative position of work implement 2 measured when the image is captured as teacher data. From the calculated error of the output value, computer 102A calculates through backpropagation an error of a weight applied to a connection between each neuron and another neuron and an error of the threshold value of each neuron.

Subsequently, in step S105, position estimation model 80 is updated. Computer 102A, more specifically, position estimation model updating unit 67, updates parameters of position estimation model 80 such as a weight applied to a connection between each neuron and another neuron and each neuron's threshold value, based on the error of the estimated value with respect to the true value of the relative position of work implement 2, as calculated in error detection unit 66, so that a value closer to the true value can be output when the same captured image is input to input layer 81. The updated parameters of position estimation model 80 are stored to storage device 104.

When estimating a relative position of work implement 2 next time, a captured image is input to position estimation model 80 updated and a result of an estimation of the relative position of work implement 2 is obtained. Computer 102A repeats step S101 to step S105 until the result of the estimation of the relative position of work implement 2 that is output by position estimation model 80 matches the measured relative position of work implement 2. Position estimation model 80 thus has its parameters optimized and is thus trained.

Once position estimation model 80 has sufficiently been trained and as a result come to output a sufficiently accurate estimation result, computer 102A finishes training position estimation model 80. Position estimation model 80 has thus been trained. Then, the process ends (end).

Initial values for a variety of parameters of position estimation model 80 may be provided by a template. Alternatively, the initial values for the parameters may be manually provided by human input. When re-training position estimation model 80, computer 102A may prepare initial values for the parameters based on values stored in storage device 104 as the parameters of position estimation model 80 to be re-trained.

Figure 8:
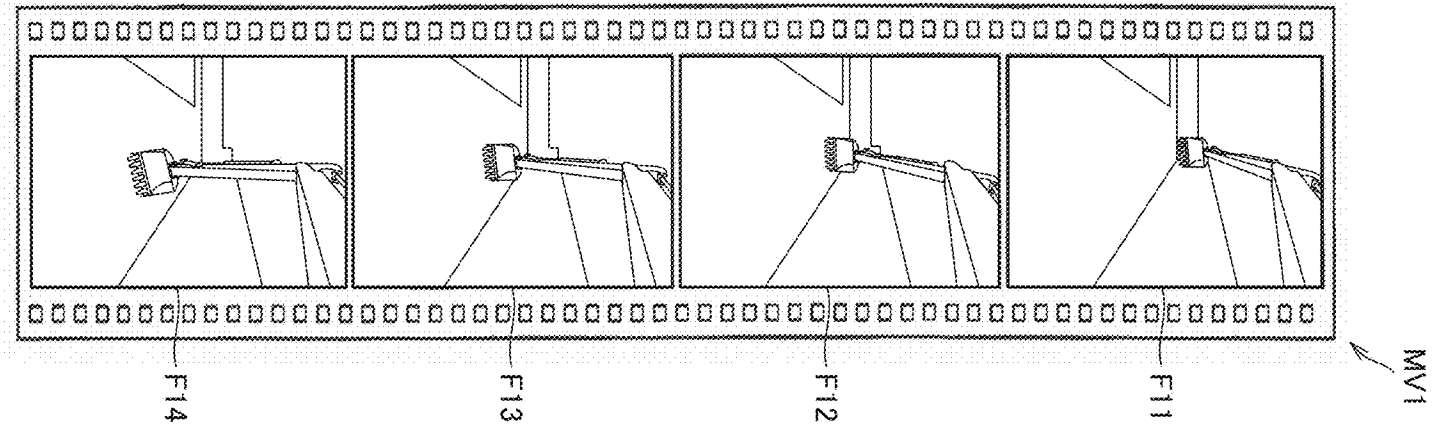
FIG. 8 is a schematic diagram showing an example of a captured image.

FIG. 8 is a schematic diagram showing an example of a captured image. As shown in FIG. 8, an image captured by imaging device 50 may be motion video MV1 of work implement 2. FIG. 8 exemplarily shows only images F11 to F14, which are some of a plurality of images included in motion video MV1. Images F11 to F14 are each time-stamped. Computer 102A (or image processing unit 61) for example extracts image F11 from motion video MV1. When doing so, computer 102 obtains measurement data of a relative position of work implement 2 detected at the same time as the time stamp provided to image F11, and assigns the measurement data to the captured image.

Figure 9:
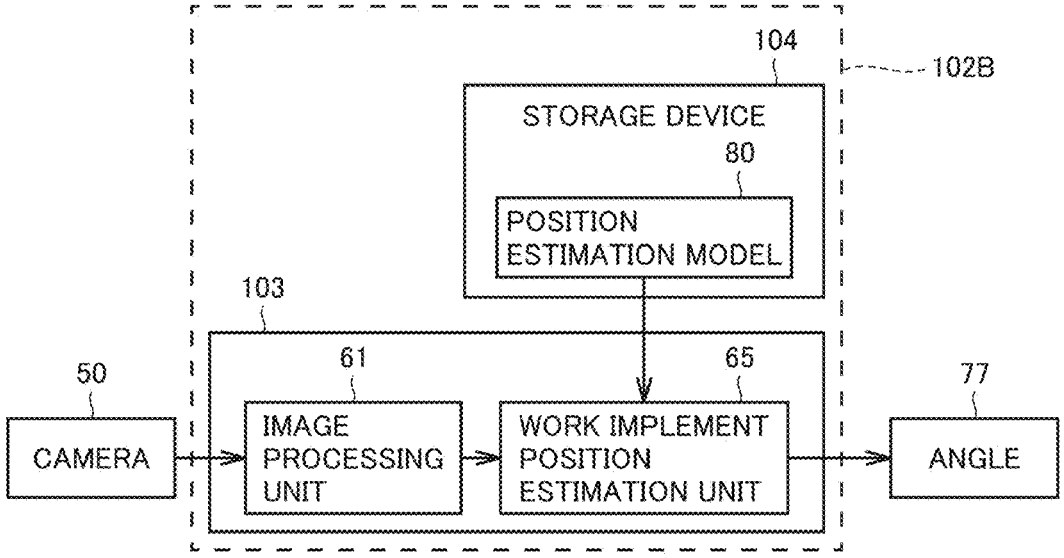
FIG. 9 is a block diagram showing a system configuration of the hydraulic excavator when it is shipped from a factory.

FIG. 9 is a block diagram showing a system configuration of hydraulic excavator 100 shipped from a factory. Encoder 161 is temporarily attached to work implement 2 for the purpose of training position estimation model 80 before shipment, and is removed from work implement 2 once training position estimation model 80 has been completed. Hydraulic excavator 100 shipped from the factory does not include encoder 161. Hydraulic excavator 100 shipped from the factory includes only imaging device 50 and computer 102B (processor 103 and storage device 104) out of the system configuration shown in FIG. 5.

Figure 10:
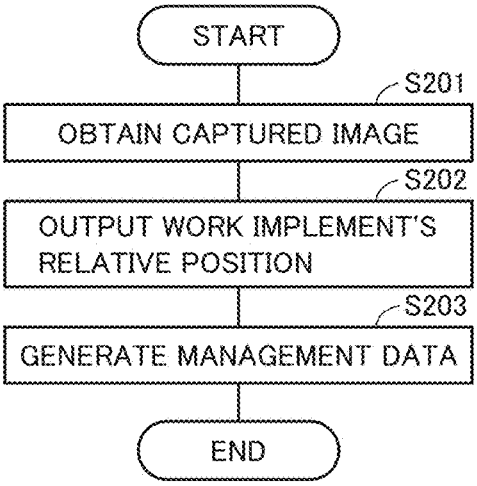
FIG. 10 is a flowchart of a process performed by a computer to estimate a relative position of the work implement after shipment from a factory.
Figure 11:
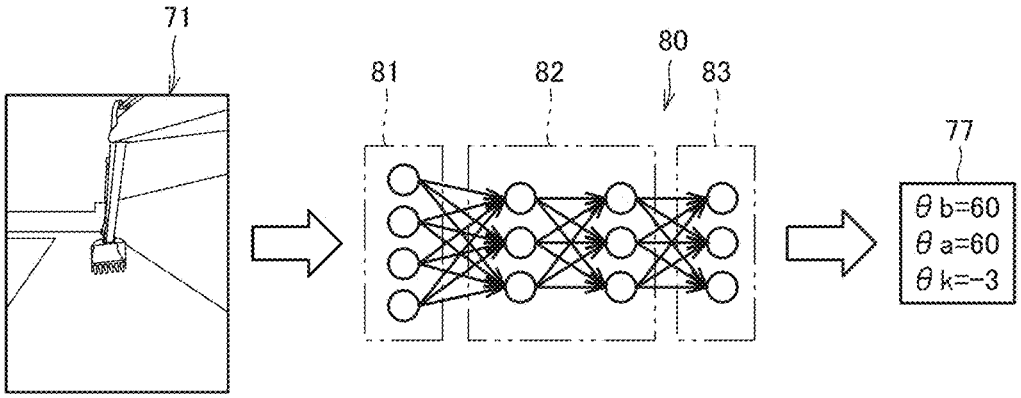
FIG. 11 is a schematic diagram representing a process for estimating a relative position of the work implement from a captured image by using the position estimation model trained.

FIG. 10 is a flowchart of a process performed by computer 102B to estimate a relative position of work implement 2 after shipment from a factory. FIG. 11 is a schematic diagram representing a process for estimating a relative position of work implement 2 from a captured image by using position estimation model 80 that has been trained so as to determine the relative position of work implement 2 from the captured image. With reference to FIGS. 9 to 11, a process for estimating a relative position of work implement 2 from an image captured at a work site after shipment from a factory will be described below.

Initially, in step S201, a captured image is obtained. Computer 102B, more specifically, image processing unit 61 obtains from imaging device (a camera) 50 an image 71 (see FIG. 11) captured by imaging device 50.

Subsequently, in step S202, a relative position of work implement 2 is output. Computer 102B, more specifically, work implement position estimation unit 65 reads position estimation model 80 and a trained parameter's optimal value from storage device 104 to obtain position estimation model 80 trained. Work implement position estimation unit 65 uses image 71 captured by imaging device 50 as data input to position estimation model 80. Work implement position estimation unit 65 inputs the captured image 71 to each neuron included in input layer 81 of position estimation model 80 trained. Position estimation model 80 trained outputs from output layer 83 an estimated position of work implement 2 relative to main body 1, more specifically, an output angle value 77 indicating boom angle θb, dipper stick angle θa and bucket angle θk (see FIG. 11).

Finally, in step S203, computer 102B generates management data including the position of work implement 2 relative to main body 1. Computer 102B records the management data in storage device 104. Then, the process ends (end).

As described above, in the system according to the embodiment, computer 102B has position estimation model 80 trained for determining a position of work implement 2 relative to main body 1. As shown in FIGS. 9 to 11, computer 102B is programmed to obtain image 71 of work implement 2 captured by imaging device 50 and use position estimation model 80 trained to obtain a relative position of work implement 2 estimated from image 71 captured.

Thus, a posture of work implement 2 can be estimated using position estimation model 80 of artificial intelligence suitable for estimating a position of work implement 2 relative to main body 1. Thus, the posture of work implement 2 can be easily and accurately determined by computer 102B using artificial intelligence.

As work implement 2's posture can be estimated from a captured image of the work implement, a sensor can be dispensed with for sensing boom angle θb, dipper stick angle θa and bucket angle θk. As the sensor is absent, its durability does not affect the operation of hydraulic excavator 100, either. This allows a simple, inexpensive and highly reliable configuration to be used to determine the current posture of work implement 2, similarly as done in hydraulic excavator 100 as conventional.

As shown in FIG. 5, computer 102A is programmed such that position estimation model 80 is updated based on an error between a relative position of work implement 2 estimated from a captured image and a relative position of work implement 2 measured when that image is captured. This allows position estimation model 80 to be trained sufficiently before shipment from a factory to have high accuracy.

When hydraulic excavator 100 shipped from a factory is equipped with a sensor such as encoder 161 for sensing boom angle θb, dipper stick angle θa and bucket angle θk, it is also possible to additionally train position estimation model 80 after the shipment from the factory.

As shown in FIG. 7, measurement data of a relative position of work implement 2 may include boom angle θb, dipper stick angle θa, and bucket angle θk. Information of a captured image and angles of work implement 2 relative to main body 1, that are previously associated with one another and thus stored, can be used to determine boom angle θb, dipper stick angle θa and bucket angle θk from an image captured by imaging device 50.

As shown in FIG. 8, an image captured by imaging device 50 may be motion video MV1 of work implement 2. Motion video MV1 is obtained to sequentially create a plurality of timestamped images which are in turn each assigned a relative position of work implement 2 that is measured when the image is captured to provide training data to efficiently train position estimation model 80.

As shown in FIG. 3, imaging device 50 has optical axis AX intersecting operating plane P of work implement 2. This allows imaging device 50 to capture an image of work implement 2 in a direction intersecting operating plane P, and a position of work implement 2 in the captured image can be uniquely associated with that of work implement 2 on operating plane P. Thus the captured image can be used to determine the current posture of work implement 2 accurately.

Figure 12:
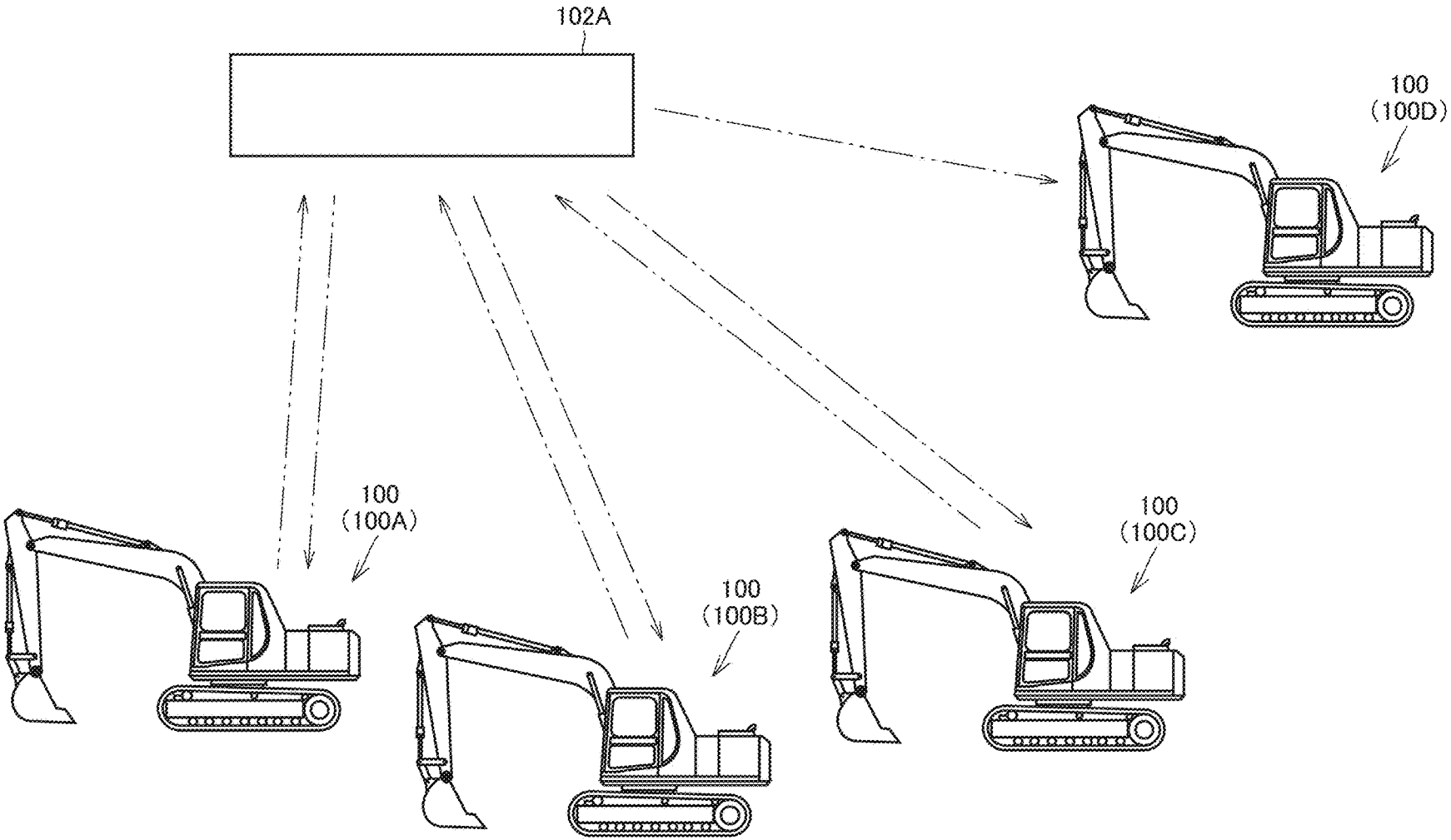
FIG. 12 is a schematic diagram showing a modified example of training a position estimation model.

FIG. 12 is a schematic diagram showing a modified example of training position estimation model 80. In the description for FIGS. 5 to 7, an example in which position estimation model 80 is trained before hydraulic excavator 100 is shipped from a factory has been described. Training data for training position estimation model 80 may be collected from a plurality of hydraulic excavators 100.

FIG. 12 shows a first hydraulic excavator 100 (a hydraulic excavator 100A), a second hydraulic excavator 100 (a hydraulic excavator 100B), a third hydraulic excavator 100 (a hydraulic excavator 100C), and a fourth hydraulic excavator 100 (a hydraulic excavator 100D), which are of the same model. Hydraulic excavators 100A, 100B, 100C include imaging device 50 and encoder 161. Hydraulic excavators 100A, 100B, 100C have been shipped from a factory and are currently each located at a work site.

Computer 102A obtains an image captured by imaging device 50 from each of hydraulic excavators 100A, 100B, 100C. Computer 102A also obtains from each of hydraulic excavators 100A, 100B, 100C, in association with the captured image, boom angle θb, dipper stick angle θa and bucket angle θk measured when the image is captured. Computer 102A uses the captured image and angles of work implement 2 obtained at the same time to train position estimation model 80 so that a relative position of work implement 2 estimated from a captured image can be obtained.

Computer 102A may obtain a captured image and measurement data of angles of work implement 2 from each of hydraulic excavators 100A, 100B, 100C via communication interface 105 (see FIG. 4). Alternatively, computer 102A may obtain a captured image and measurement data of angles of work implement 2 from each hydraulic excavator 100A, 100B, 100C via external recording medium 109.

Computer 102A may be located at the same work site as hydraulic excavators 100A, 100B, 100C. Alternatively, computer 102A may be located in a remote place away from a work site, such as a management center for example. Hydraulic excavators 100A, 100B, 100C may be located at the same work site or at different work sites.

Position estimation model 80 trained is provided to each hydraulic excavator 100A, 100B, 100C via communication interface 105, external recording medium 109, or the like. Each hydraulic excavator 100A, 100B, 100C is thus provided with position estimation model 80 trained.

When position estimation model 80 is already stored in each hydraulic excavator 100A, 100B, 100C, position estimation model 80 stored is overwritten. Position estimation model 80 may be overwritten periodically by periodically collecting training data and training position estimation model 80, as described above. Whenever position estimation model 80 has a parameter updated, the latest, updated value is stored to storage device 104.

Position estimation model 80 trained is also provided to hydraulic excavator 100D. Position estimation model 80 is provided to both hydraulic excavators 100A, 100B, 100C that provide training data and hydraulic excavator 100D that does not provide training data. Hydraulic excavator 100D may be located at the same work site as any of hydraulic excavators 100A, 100B, 100C, or may be located at a work site different than hydraulic excavators 100A, 100B, 100C. Hydraulic excavator 100D may be before shipment from a factory.

Figure 13:
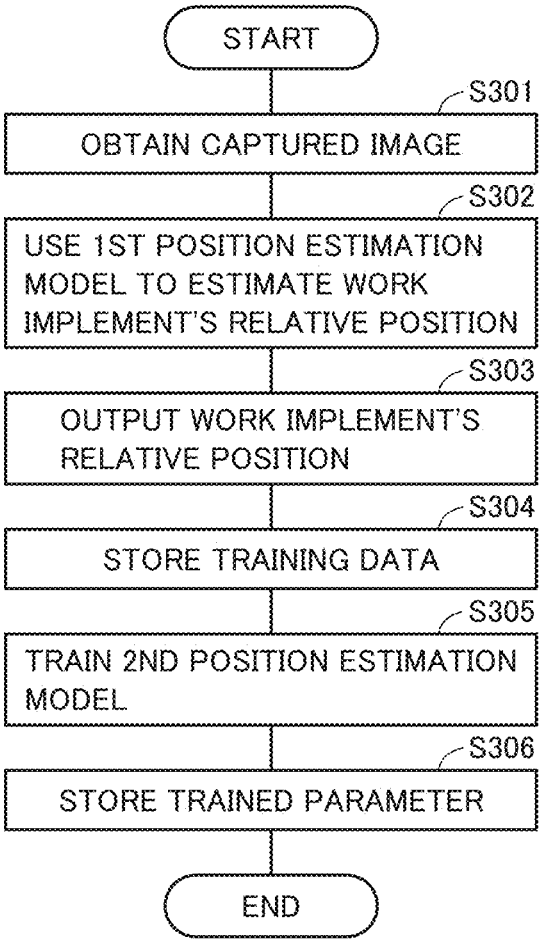
FIG. 13 is a flowchart of a process for generating a distillation model.

Position estimation model 80 described above is not limited to a model trained through machine learning using training data 61A, 61B, 61C, . . . , and may be a model generated using the trained model. For example, position estimation model 80 may be another trained model (a distillation model) trained based on a result obtained by repeatedly inputting/outputting data to/from a trained model. FIG. 13 is a flowchart of a process for generating a distillation model.

As shown in FIG. 13, initially, in step S301, a captured image is obtained. Computer 102A, more specifically, image processing unit 61 obtains from imaging device (a camera) 50 image 71 (see FIG. 11) captured by imaging device 50.

Subsequently, in step S302, computer 102A uses a trained first position estimation model to obtain an estimated position of work implement 2 relative to main body 1. In step S303, computer 102A outputs the estimated relative position of work implement 2.

Computer 102A, more specifically, work implement position estimation unit 65 reads the trained first position estimation model from storage device 104. Work implement position estimation unit 65 inputs image 71 captured by imaging device 50 to input layer 81 of the trained first position estimation model. The trained first position estimation model outputs from output layer 83 a result of an estimation of a position of work implement 2 relative to main body 1, more specifically, output angle value 77 (see FIG. 11) indicating boom angle θb, dipper stick angle θa and bucket angle θk.

Subsequently, in step S304, computer 102A stores the captured image obtained in step S301 and the result of the estimation of the relative position of work implement 2 output in step S303 in storage device 104 as training data.

Subsequently, in step S305, computer 102A uses the trained model to train a second position estimation model. Computer 102A inputs a captured image to an input layer of the second position estimation model. Computer 102A outputs from an output layer of the second position estimation model an output value indicating a result of an estimation of a position of work implement 2 relative to main body 1, more specifically, boom angle θb, dipper stick angle θa and bucket angle θk. A difference is calculated between the relative position of work implement 2 output from the second position estimation model and the relative position of work implement 2 output from the first position estimation model in step S303. Based on this difference, computer 102A updates the second position estimation model's parameters. The second position estimation model is thus trained.

Finally, in step S306, the updated parameters of the second position estimation model are stored in storage device 104 as trained parameters. Then, the process ends (end).

Thus, a captured image of work implement 2 and a relative position of work implement 2 estimated through a first position estimation model can be used as training data to train a second position estimation model (or obtain a distillation model), and computer 102A can use the second position estimation model that is simpler than the first position estimation model to estimate a position of work implement 2 relative to main body 1. This can alleviate a load imposed on computer 102A for estimating the relative position of work implement 2. Computer 102A may train the second position estimation model by using training data generated by another computer.

In the above embodiment, position estimation model 80 includes a neural network. This is not exclusive, however, and position estimation model 80 may be a model, such as a support vector machine, capable of accurately estimating a position of work implement 2 relative to main body 1 from a captured image of work implement 2 through machine learning.

The work machine to which the idea of the present disclosure is applicable is not limited to a hydraulic excavator, and may be a work machine having a work implement, such as a bulldozer, a motor grader, or a wheel loader.

The presently disclosed embodiments are to be considered as illustrative in any respect and not restrictive. The scope of the present invention is not indicated by the above description but by the scope of the claims, and is intended to include meaning equivalent to the terms of the claims and any modifications within the scope.

REFERENCE SIGNS LIST

1 main body, 2 work implement, 3 revolving unit, 6 boom, 7 dipper stick, 8 bucket, 50 imaging device, 61 image processing unit, 61A, 61B, 61C training data, 65 work implement position estimation unit, 66 error detection unit, 67 position estimation model updating unit, 71 captured image, 77 output angle value, 80 position estimation model, 81 input layer, 82 intermediate layer, 83 output layer, 100, 100A, 100B, 100C, 100D hydraulic excavator, 102A, 102B computer, 103 processor, 104 storage device, 105 communication interface, 106 I/O interface, 107 input device, 108 output device, 109 external recording medium, 161 encoder, 162 angle conversion unit, AX optical axis, MV1 motion video, P operating plane.

The invention claimed is:

1. A system comprising:

a work machine body;

a work implement attached to the work machine body;

an imaging device that captures an image of the work implement; and a computer;

the computer having a trained position estimation model to determine a position of the work implement, the computer being programmed to obtain a captured image of the work implement captured by the imaging device and use the trained position estimation model to obtain an estimated position of the work implement estimated from the captured image, the trained position estimation model is an artificial intelligence model including a neural network, the neural network includes an input layer, an intermediate layer, and an output layer, the input layer, the intermediate layer, and the output layer each have one or more neurons, and the computer is programmed to input the captured image to each neuron included in the input layer and output from the output layer the estimated position of the work implement.

2. The system according to claim 1, wherein the position of the work implement is a relative position of the work implement relative to the work machine body.

3. The system according to claim 2, wherein the work implement has a boom coupled to the work machine body, a dipper stick coupled to the boom, and a bucket coupled to the dipper stick, and the estimated position includes an angle of the boom with respect to the work machine body, an angle of the dipper stick with respect to the boom, and an angle of the bucket with respect to the dipper stick.

4. The system according to claim 2, wherein the computer is programmed so that the trained position estimation model is updated based on an error between the estimated position and the relative position measured when the image is captured.

5. The system according to claim 1, wherein the captured image is a frame image obtained from motion video of the work implement.

6. The system according to claim 1, wherein the imaging device is attached to the work machine body, the work implement operates on a prescribed operating plane, and the imaging device has an optical axis intersecting the operating plane.

7. The system according to claim 1, wherein the work implement has an attachment, and the position of the work implement is a position of the attachment.

8. A method implemented by a computer, comprising:

obtaining an image including a work implement provided to a work machine body; and using a trained position estimation model for determining a position of the work implement to obtain an estimated position of the work implement estimated from the image, the trained position estimation model is an artificial intelligence model including a neural network, the neural network includes an input layer, an intermediate layer, and an output layer, the input layer, the intermediate layer, and the output layer each have one or more neurons, and wherein using the trained position estimation model to obtain the estimated position of the work implement includes inputting the captured image into each neuron included in the input layer and outputting from the output layer the estimated position of the work implement.

9. A method for producing a trained position estimation model, comprising:

obtaining training data including a captured image of a work implement attached to a work machine body and a measured position of the work implement measured when the image is captured; and training the position estimation model by using the training data, wherein the training includes using the position estimation model to obtain an estimated position of the work implement estimated from the captured image;

the position estimation model is an artificial intelligence model including a neural network, the neural network includes an input layer, an intermediate layer, and an output layer, the input layer, the intermediate layer, and the output layer each have one or more neurons, and wherein using the position estimation model to obtain the estimated position of the work implement includes inputting the captured image into each neuron included in the input layer and outputting from the output layer the estimated position of the work implement.

10. The method according to claim 9, wherein the training includes:

calculating an error of the estimated position with respect to the measured position; and updating the position estimation model based on the error.

11. A non-transitory computer readable storage medium storing training data for training a position estimation model used to determine a position of a work implement, the stored training data comprising:

a captured image of the work implement captured by an imaging device; and a measured position of the work implement measured when the captured image is captured, wherein the position estimation model is an artificial intelligence model including a neural network, the neural network includes an input layer, an intermediate layer, and an output layer, and the input layer, the intermediate layer, and the output layer each have one or more neurons.

12. The non-transitory computer readable storage medium according to claim 11, wherein the position of the work implement is a position of the work implement relative to a work machine body.

13. The non-transitory computer readable storage medium according to claim 12, the work implement has a boom coupled to the work machine body, a dipper stick coupled to the boom, and a bucket coupled to the dipper stick, and the measured position includes an angle of the boom with respect to the work machine body, an angle of the dipper stick with respect to the boom, and an angle of the bucket with respect to the dipper stick.

14. A method for producing a trained position estimation model, comprising:

obtaining a captured image of a work implement attached to a work machine body;

using a trained first position estimation model to obtain an estimated position of the work implement estimated from the captured image; and training a second position estimation model by using training data including the captured image and the estimated position, the trained first position estimation model is an artificial intelligence model including a neural network, the neural network includes an input layer, an intermediate layer, and an output layer, the input layer, the intermediate layer, and the output layer each have one or more neurons, and wherein using the trained first position estimation model to obtain the estimated position of the work implement includes inputting the captured image into each neuron included in the input layer and outputting from the output layer the estimated position of the work implement.

* * * * *